US008328589B2

(12) United States Patent
Hasebe et al.

(10) Patent No.: US 8,328,589 B2
(45) Date of Patent: Dec. 11, 2012

(54) CONTACT

(75) Inventors: Kiyoharu Hasebe, Tokyo (JP); Junichi Miyamoto, Tokyo (JP); Kiyohito Koide, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/964,886

(22) Filed: Dec. 10, 2010

(65) Prior Publication Data

US 2011/0223799 A1 Sep. 15, 2011

(30) Foreign Application Priority Data

Mar. 12, 2010 (JP) ..... 2010-055496

(51) Int. Cl.
*H01R 4/10* (2006.01)

(52) U.S. Cl. ..... 439/877

(58) Field of Classification Search ..... 439/877, 439/884

See application file for complete search history.

(56) References Cited

U.S. PATENT DOCUMENTS 2,508,171 A * 5/1950 Kaufman ..... 204/196.16
2,535,013 A * 12/1950 Freedom ..... 439/877
2,622,314 A * 12/1952 Bergan ..... 29/517
2,693,216 A * 11/1954 Broske et al. ..... 72/412
2,816,276 A * 12/1957 Fuller et al. ..... 439/866
2,906,987 A * 9/1959 Fox, Jr. ..... 439/203
3,314,044 A * 4/1967 Powell ..... 439/851
3,541,227 A * 11/1970 Bendrick ..... 174/94 R
4,009,927 A * 3/1977 Knowles ..... 439/682
4,815,200 A * 3/1989 Ito ..... 29/857
5,338,233 A * 8/1994 Endo et al. ..... 439/877
5,733,154 A * 3/1998 Libregts ..... 439/850
6,626,711 B2 * 9/2003 Kitagawa et al. ..... 439/877
7,803,008 B2 * 9/2010 Onuma ..... 439/442

FOREIGN PATENT DOCUMENTS

JP 2001-357901 A 12/2001

* cited by examiner

*Primary Examiner* — Amy Cohen Johnson
*Assistant Examiner* — Vladimir Imas
(74) *Attorney, Agent, or Firm* — Holtz, Holtz, Goodman & Chick, PC

(57) ABSTRACT

A contact of which the quality of crimping of a crimp portion can be easily and accurately determined. The crimp portion of the contact includes a bottom portion that supports conductors of electrical wires, and two side portions that are continuous with opposite sides of the bottom portion and are bent such that they hold the conductors therein. Three marks are formed in an outer surface of each side portion along a longitudinal direction of the contact.

16 Claims, 24 Drawing Sheets

CONTACT

BACKGROUND OF THE INVENTION

1. Field of the Invention

This invention relates to a contact.

2. Description of the Related Art

Conventionally, there has been proposed a crimp terminal including a crimp portion (see Japanese Laid-Open Patent Publication (Kokai) No. 2001-357901, Paragraphs 0015 to 0017, 0022, FIGS. 8 and 9).

The crimp portion has a substantially U-shaped cross-section. The crimp portion includes a bottom portion and a pair of side pieces that are continuous with opposite sides of the bottom portion.

A mark in the form of a frame is provided on an outer surface of the crimp portion. The mark is provided with scale markings arranged side by side along a longitudinal direction of the crimp terminal. The scale markings extend in parallel with two grooves.

Electrical wire cores are disposed on the bottom portion of the crimp portion, and the two side pieces are crimped by a crimp machine. After the two side pieces are crimped, the crimp portion is viewed from above to confirm whether or not scale markings on one side piece and scale markings on the other side piece are coincident with each other along the longitudinal direction of the crimp terminal, whereby it is possible to determine the quality of the crimping of the crimp portion.

In the above-described inspection method, however, even when the quality of the crimping of the crimp portion is not good, the scale markings on the one side piece and the scale markings on the other side piece are sometimes coincident with each other along the longitudinal direction of the crimp terminal, and hence there is a problem that the accuracy of determination of the quality of the crimping of the crimp portion is low.

SUMMARY OF THE INVENTION

The present invention has been made in view of these circumstances, and an object thereof is to provide a contact of which the quality of crimping of a crimp portion can be easily and accurately determined.

To attain the above object, in a first aspect of the present invention, there is provided a contact including a crimp portion that holds conductors of electrical wires by crimping, the crimp portion comprising a bottom portion that supports the conductors of electrical wires, and two side portions that are continuous with opposite sides of the bottom portion and are bent such that the side portions hold the conductors therein, wherein a plurality of marks are formed in an outer surface of each side portion along a longitudinal direction of the contact.

With the arrangement of the contact according to the first aspect of the present invention, if the quality of the crimping of the crimp portion is good, the plurality of marks are aligned along the longitudinal direction of the contact, so that after crimping the crimp portion, by confirming how the marks are aligned, it is possible to determine the quality of the crimping of the crimp portion.

Preferably, the number of the marks is at least three.

Preferably, the marks extend in the longitudinal direction of the contact.

Preferably, when the side portions are bent such that the side portions hold the conductors therein, the marks are located at positions where ridges or portions close to the ridges of the respective side portions are to be formed.

More preferably, each of the marks has a concave or convex shape, and a plurality of bottom-side marks each having a concave or convex shape are formed in an outer surface of the bottom portion along the longitudinal direction of the contact, wherein at least one of the plurality of marks formed in one of the two side portions, at least one of the plurality of marks formed in the other of the two side portions, and at least one of the plurality of bottom-side marks are located on an imaginary plane through the crimp portion which is orthogonal to the longitudinal direction of the contact.

To attain the above object, in a second aspect of the present invention, there is provided a contact including a crimp portion that holds conductors of electrical wires by crimping, the crimp portion comprising a bottom portion that supports the conductors of electrical wires, and two side portions that are continuous with opposite sides of the bottom portion and are bent such that the side portions hold the conductors therein, wherein at least one mark is formed on an outer surface of each side portion such that the mark extends from a front end-side portion to a rear end-side portion of the outer surface in a longitudinal direction of the contact.

Preferably, when the side portions are bent such that the side portions hold the conductors therein, the marks are located at positions where ridges or portions close to the ridges of the respective side portions are to be formed.

Preferably, the mark is a groove.

More preferably, at least one bottom-side mark is formed in the bottom portion such that the bottom-side mark extends from the front end-side portion to the rear end-side portion of an outer surface of the bottom portion in the longitudinal direction of the contact.

According to the present invention, it is possible to easily and accurately determine the quality of the crimping of the crimp portion of the contact.

The above and other objects, features and advantages of the present invention will become more apparent from the following detailed description taken in conjunction with the accompanying drawings.

DETAILED DESCRIPTION OF THE PREFERRED EMBODIMENTS

Figure 1:
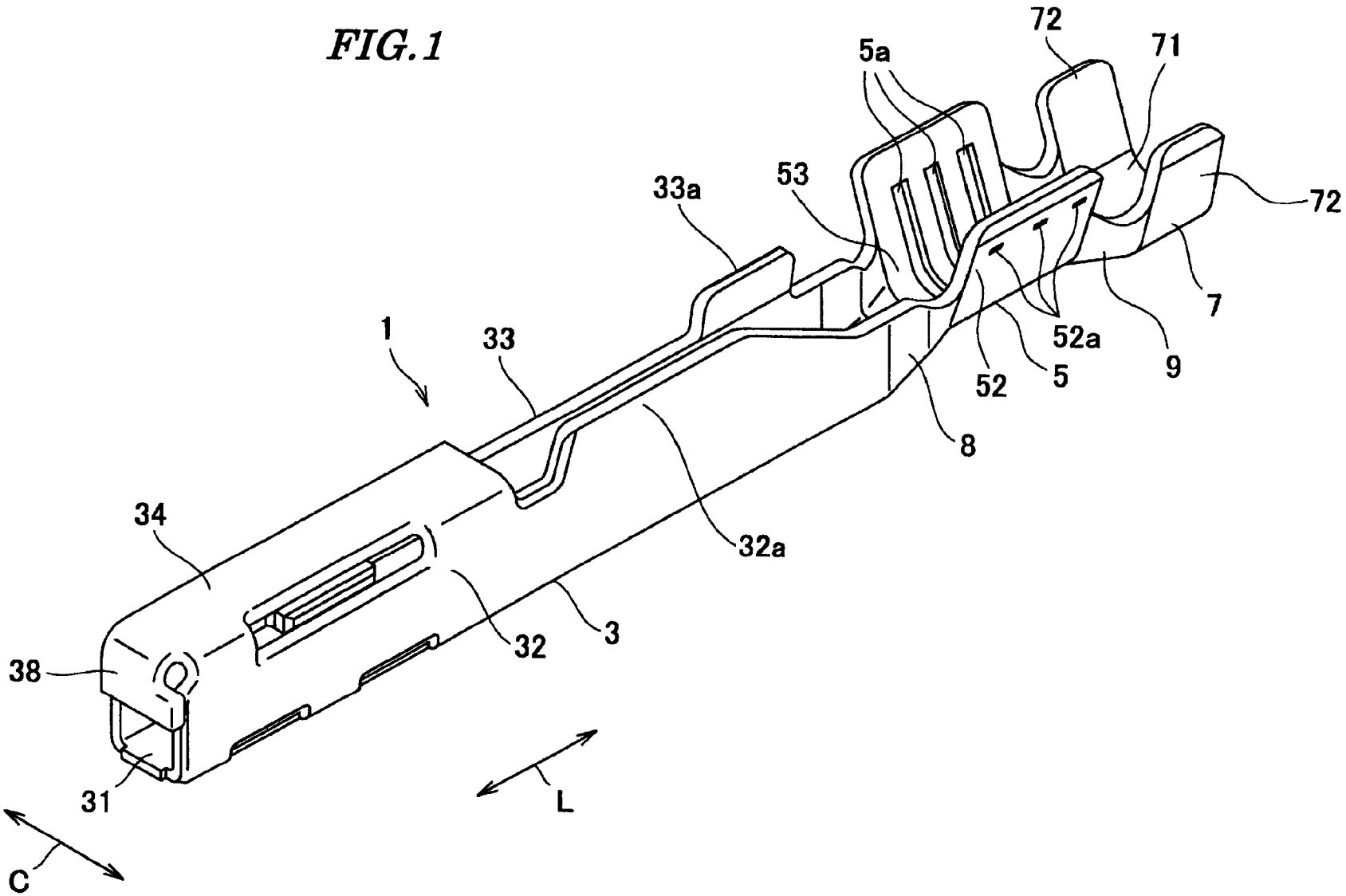
FIG. 1 is a perspective view of a contact according to a first embodiment of the present invention in a state before electrical wires are crimped thereto.

The present invention will now be described in detail with reference to the drawings showing preferred embodiments thereof.

First, a contact according to a first embodiment of the present invention will be described with reference to FIGS. 1 to 15.

As shown in FIGS. 1 to 4, the contact 1 is a socket contact, and comprises a contact portion 3, a crimp portion 5, a covering-holding portion 7, a first linking portion 8, and a second linking portion 9. The contact 1 is formed by blanking and bending a metal plate.

The contact portion 3 has a generally hollow prism shape, and receives a pin contact of a mating connector, not shown. The contact portion 3 includes a bottom portion 31, a pair of side portions 32 and 33, and a top surface portion 34.

Figure 2:
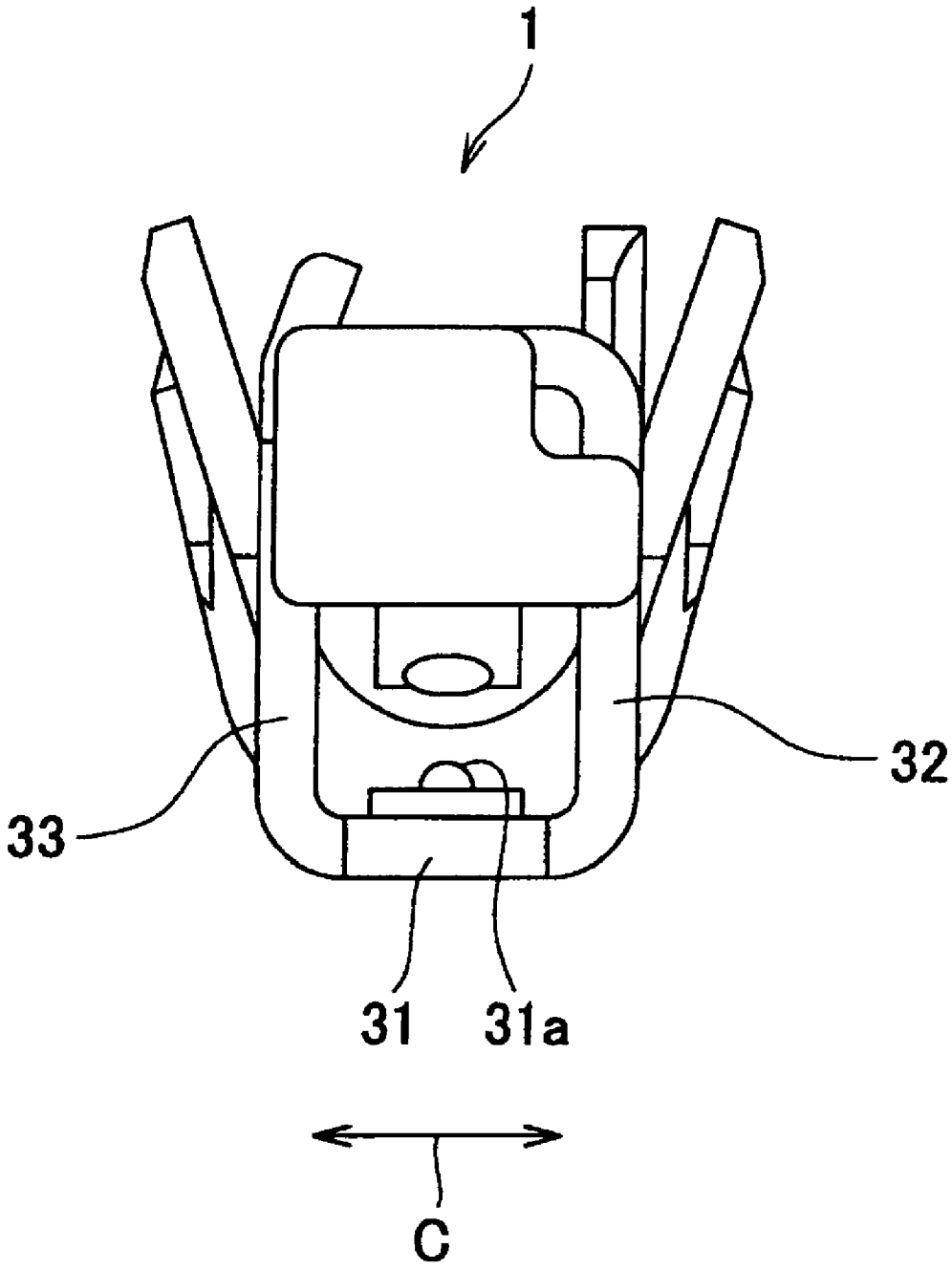
FIG. 2 is a front view of the contact shown in FIG. 1.
Figure 3:
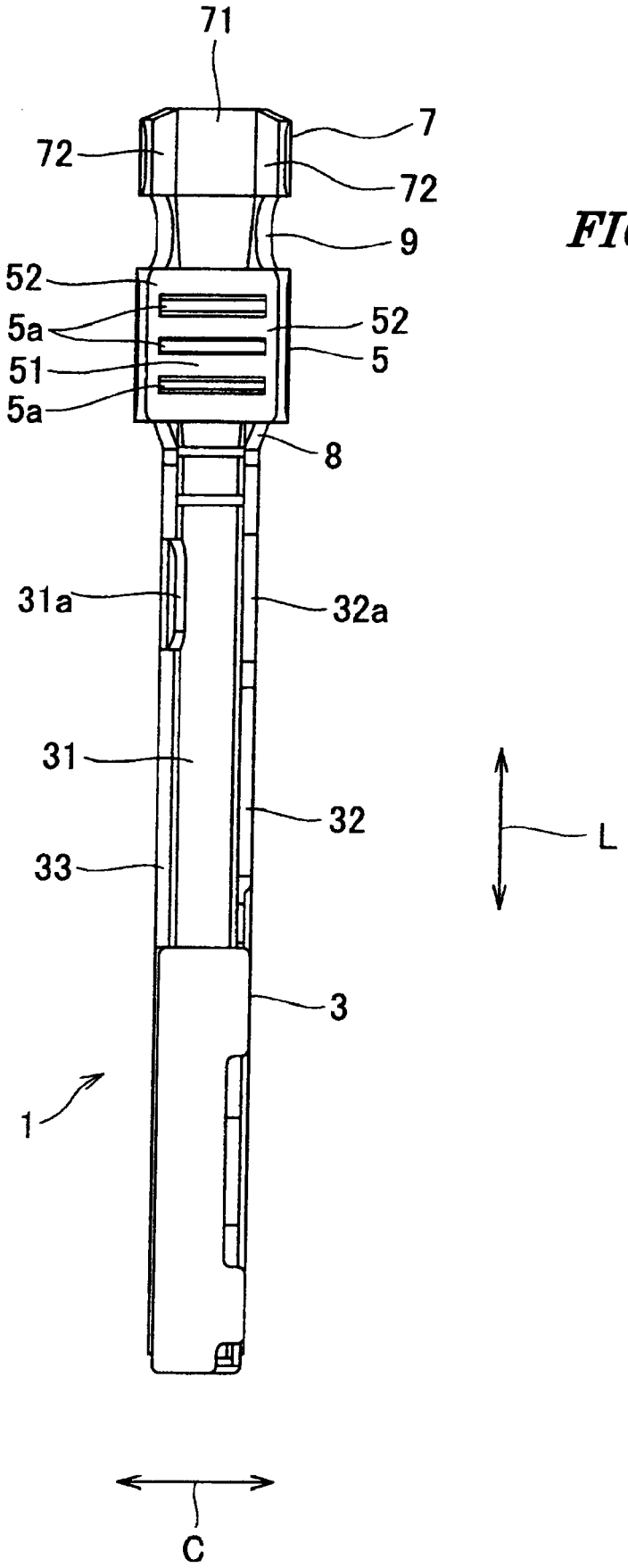
FIG. 3 is a plan view of the contact shown in FIG. 1.
Figure 4:
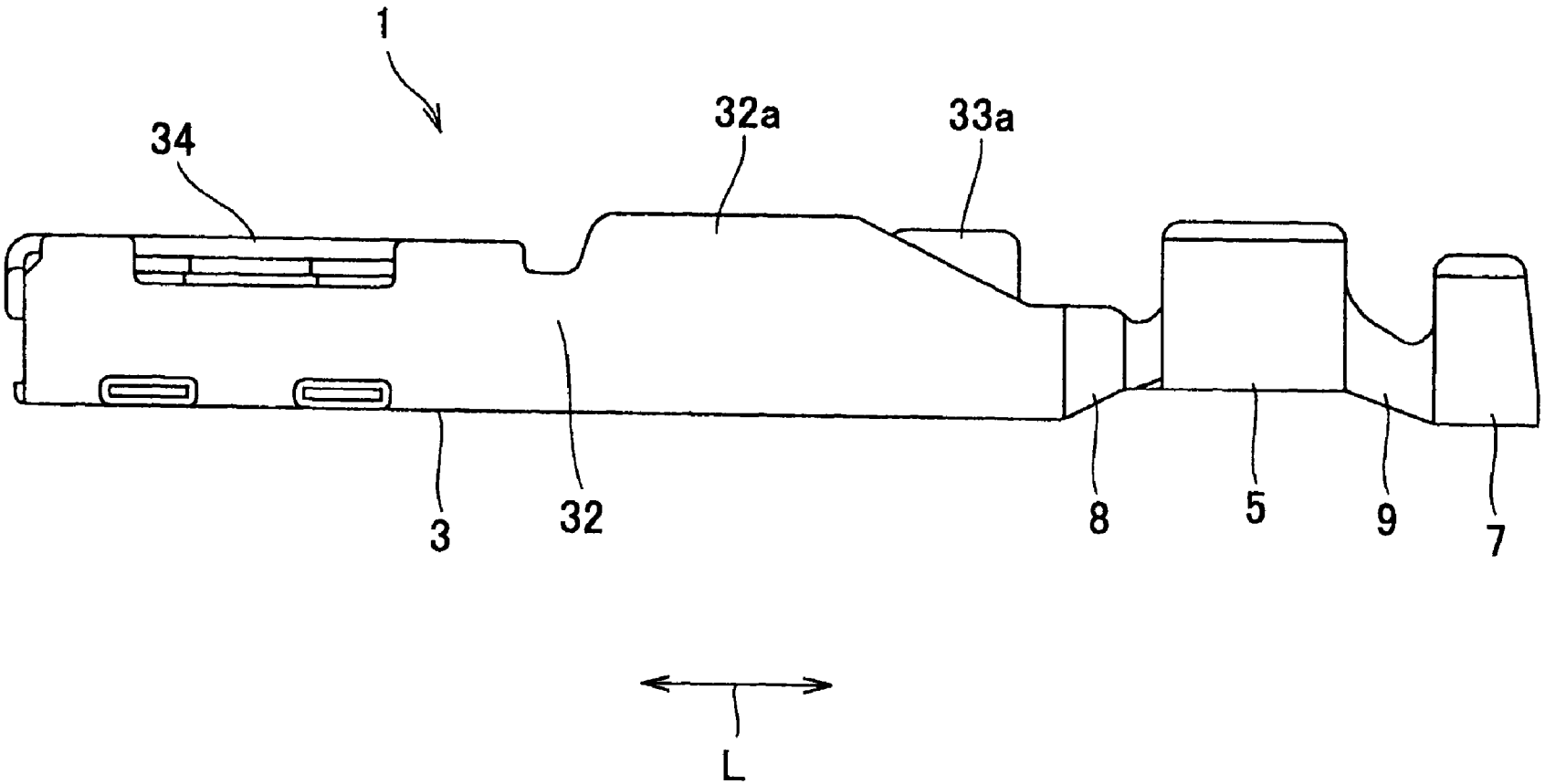
FIG. 4 is a side view of the contact shown in FIG. 1.

The bottom portion 31 has a plate-like shape, and includes a contact point 31*a* (see FIG. 2).

The side portion 32 has a plate-like shape, and is continuous with a side of the bottom portion 31. The side portion 32 is formed with a protruding piece 32*a*. The side portion 33 has a plate-like shape, and is continuous with the other side of the bottom portion 31. The side portion 33 is formed with a protruding piece 33*a*.

The top surface portion 34 has a plate-like shape, and is continuous with a top of the side portion 32. The top surface portion 34 is opposed to a front portion of the bottom portion 31. A protruding portion 38 is continuous with a front end of the top surface portion 34. The protruding portion 38 is perpendicular to the top surface portion 34, and covers an upper part of an opening of an front end of the contact portion 3.

Figure 9:
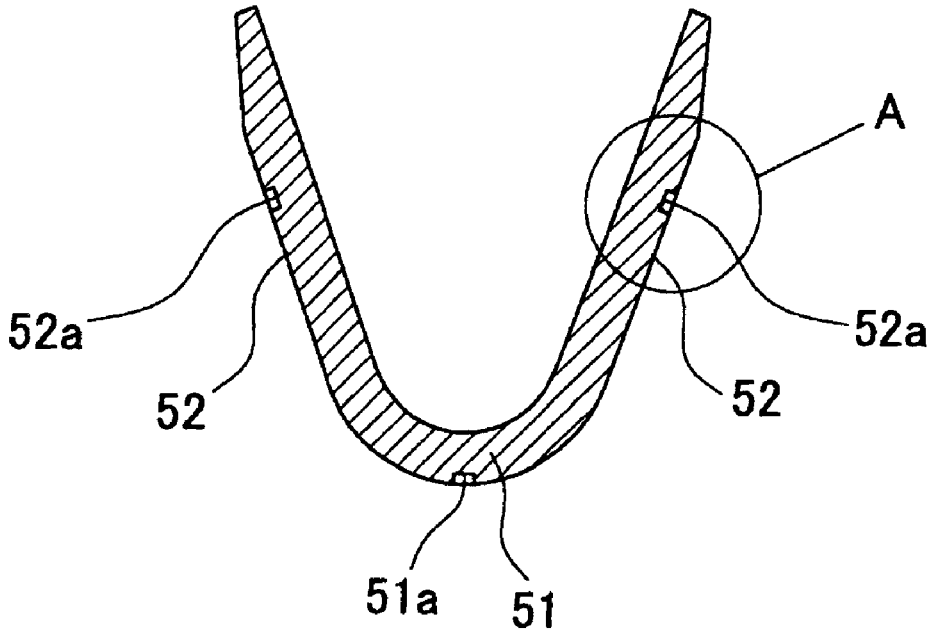
FIG. 9 is a cross-sectional view taken along line IX-IX in FIG. 6.

Before the crimp portion 5 is crimped onto conductors 21 (see FIG. 11) of electrical wires, the crimp portion 5 has a substantially U-shaped cross-section (see FIG. 9). Three serration slots 5*a* are formed in an inner surface of the crimp portion 5 at equally-spaced intervals in the longitudinal direction L of the contact (see FIGS. 5 and 7).

The covering-holding portion 7 is crimped to hold the electrical wires together with coverings of the electrical wires. When the covering-holding portion 7 do not hold any electrical wires, the covering-holding portion 7 has a substantially U-shaped cross-section.

The first linking portion 8 has a substantially U-shaped cross-section, and links the crimp portion 5 to the contact portion 3.

The second linking portion 9 has a substantially U-shaped cross-section, and links the covering-holding portion 7 to the crimp portion 5.

Referring to FIGS. 5 to 9, the crimp portion 5 includes a bottom portion 51 and two side portions 52. The bottom portion 51 supports the conductors 21 of the electrical wires. The two side portions 52 are continuous with respective opposite sides of the bottom portion 51, and are bent such that they hold the conductors 21 (see FIG. 11).

Figure 8:
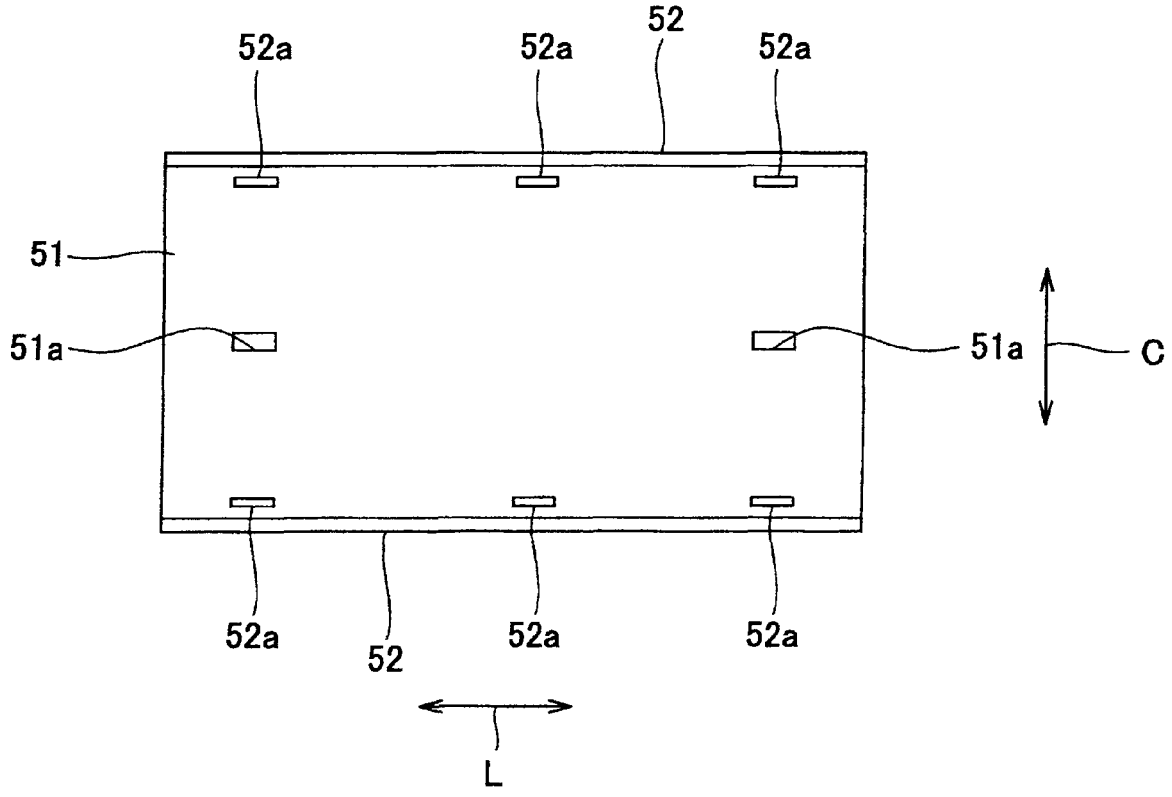
FIG. 8 is a bottom view of the crimp portion shown in FIG. 5.

As shown in FIG. 8, two bottom surface-side marks 51*a* are formed in an outer surface of the bottom portion 51 on a single imaginary line (not shown) parallel to the longitudinal direction L of the contact. The bottom surface-side marks 51*a* are located at a central portion of the bottom portion 51 (central portion in a direction C orthogonal to the longitudinal direction L of the contact). The bottom surface-side marks 51*a* have a rectangular concave shape, and extend in the longitudinal direction L of the contact. They have a rectangular cross-section (see FIG. 12).

Figure 5:
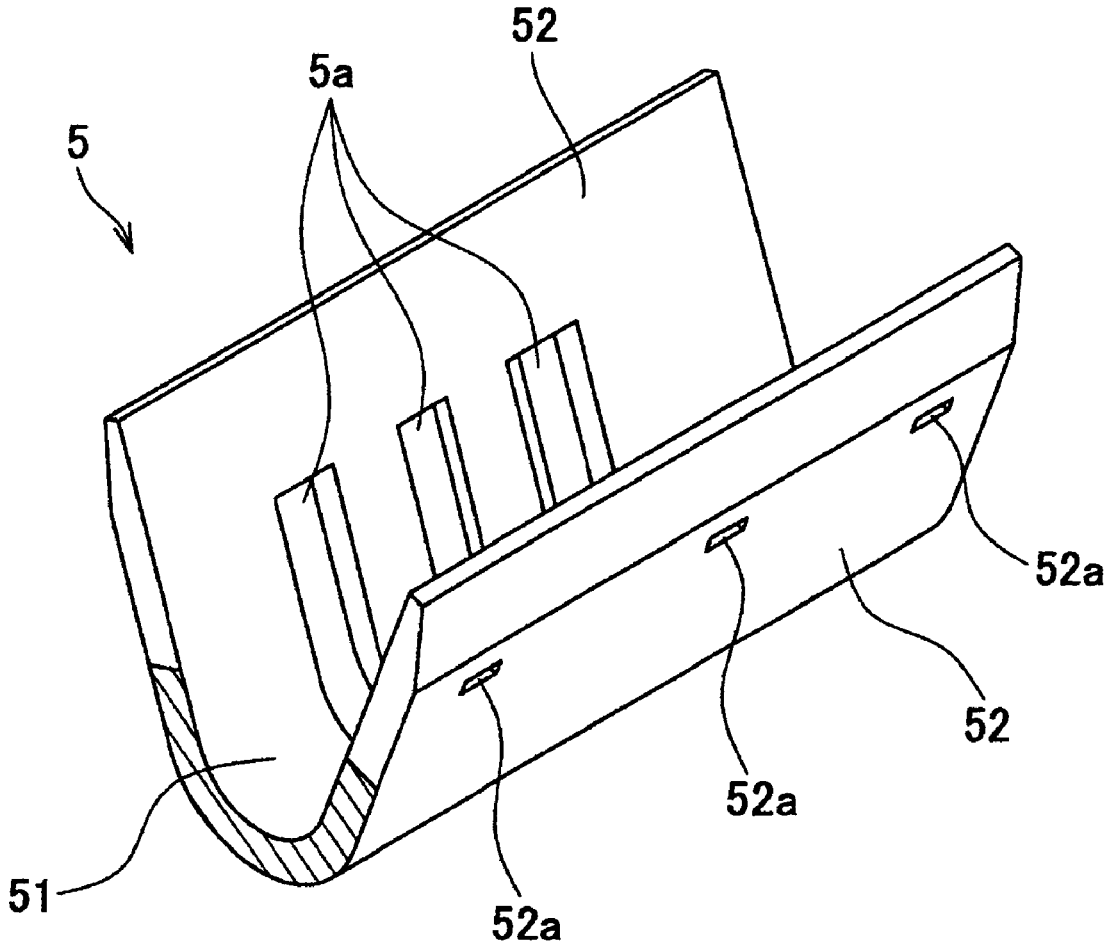
FIG. 5 is a perspective view of a crimp portion of the contact shown in FIG. 1.
Figure 6:
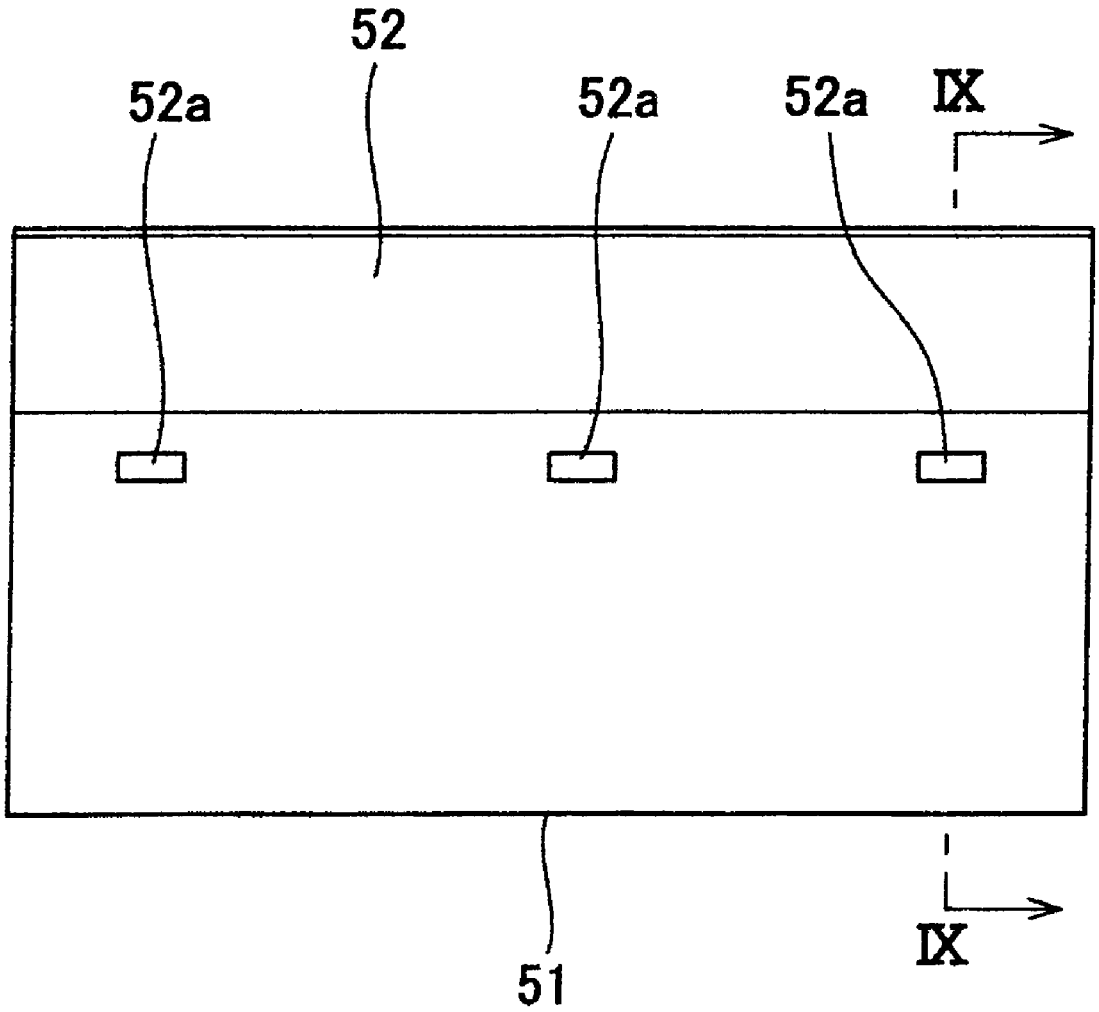
FIG. 6 is a side view of the crimp portion shown in FIG. 5.
Figure 7:
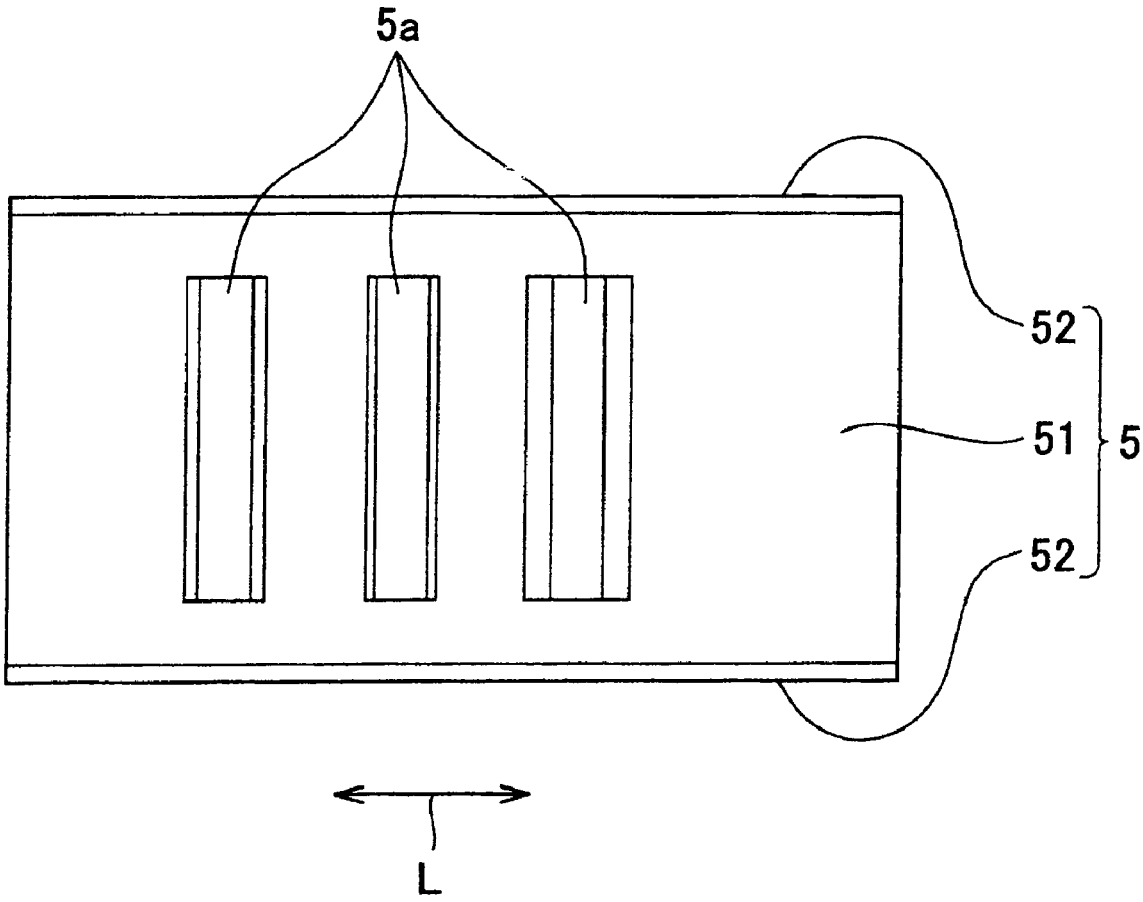
FIG. 7 is a plan view of the crimp portion shown in FIG. 5.
Figure 10:
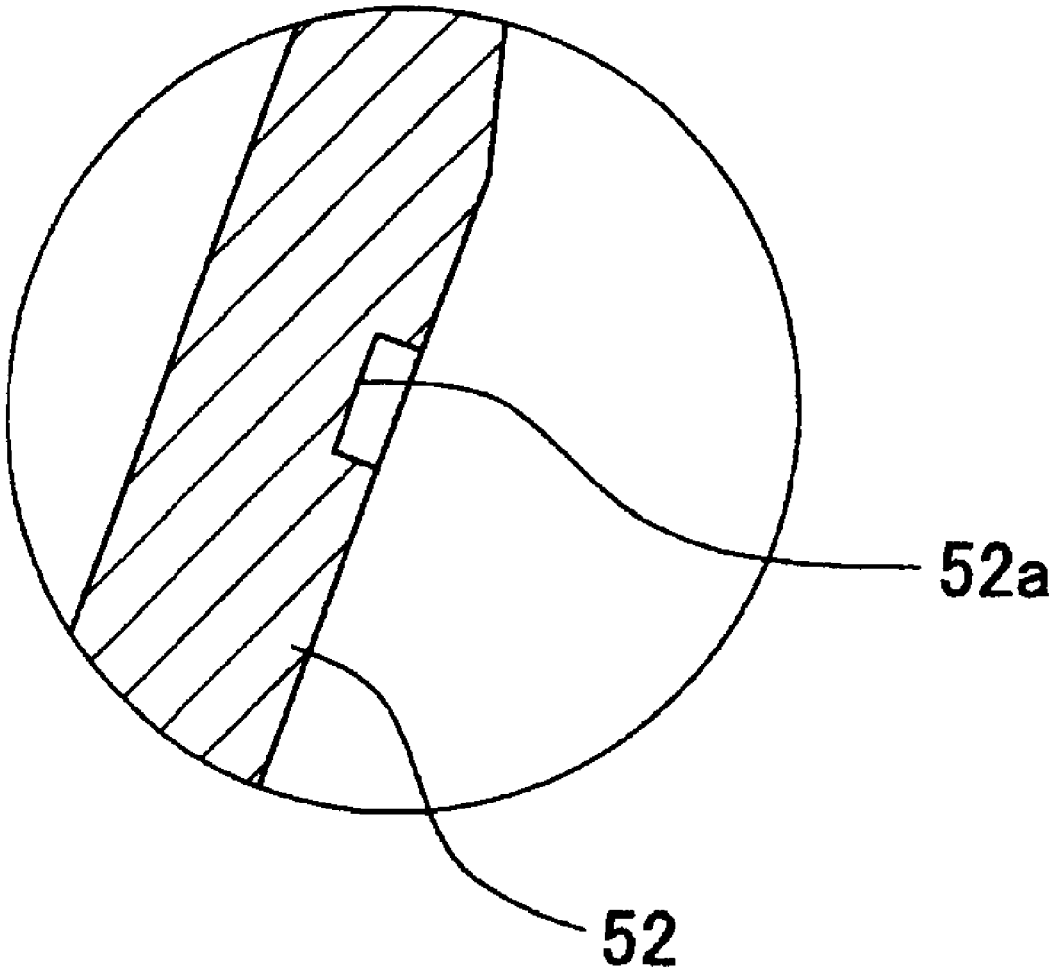
FIG. 10 is an enlarged view of part A in FIG. 9.
Figure 11:
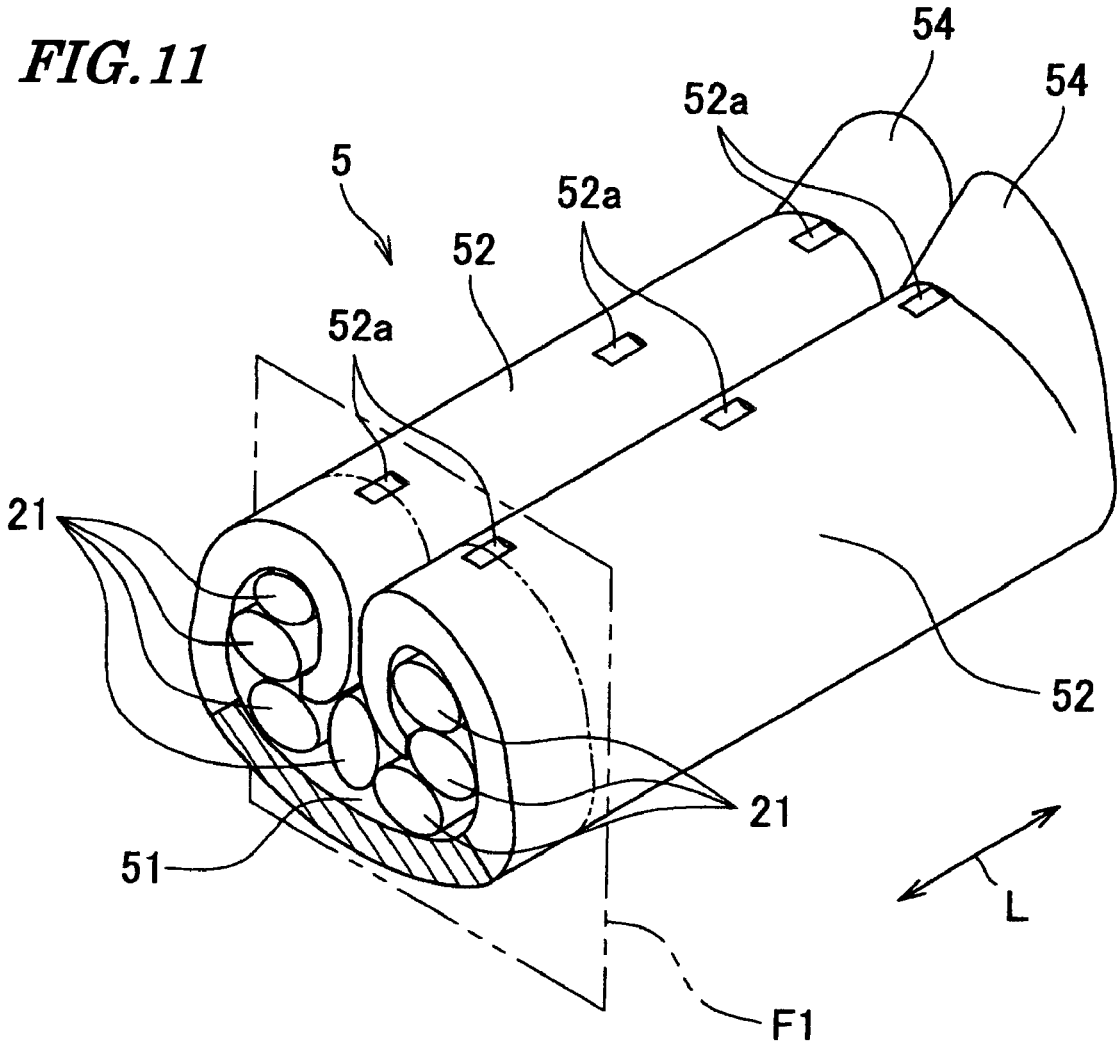
FIG. 11 is a perspective view of the crimp portion shown in FIG. 5 in a state in which it is crimped to conductors of electrical wires.
Figure 12:
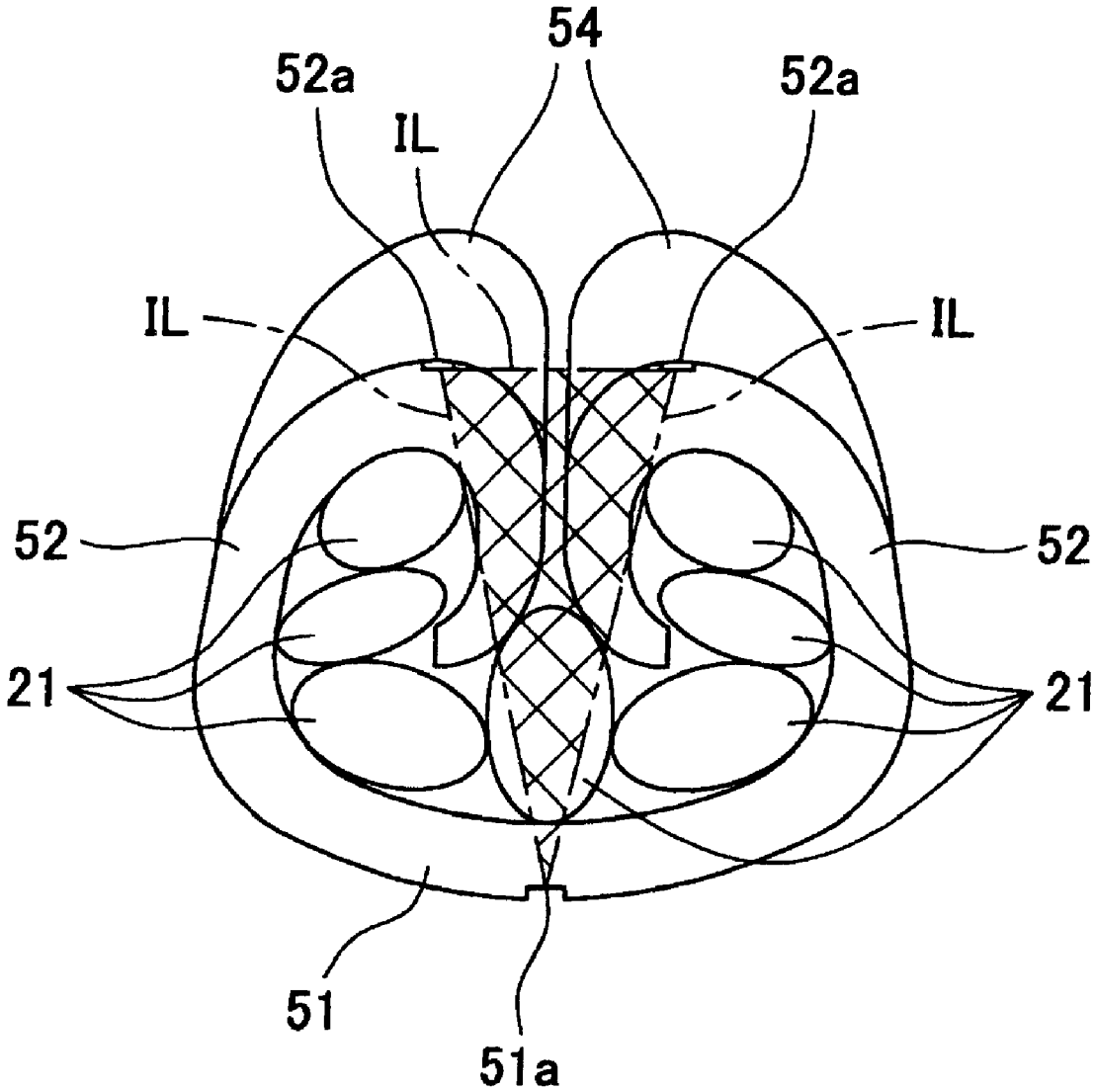
FIG. 12 is a schematic view showing a cross-section of the crimp portion along an imaginary plane F1 shown in FIG. 11.

Referring to FIGS. 5 and 6, three marks 52*a* are formed in each of respective outer surfaces of the two side portions 52 at equally-spaced intervals on an imaginary line (not shown) parallel to the longitudinal direction L of the contact. The marks 52*a* have a small rectangular concave shape. They extend in the longitudinal direction L of the contact, and have a rectangular cross-section, as illustrated in FIG. 10. The three marks 52*a* are formed in each of the respective portions of the side portions 52, which are to form ridges of the side portions 52 when the side portions 52 are bent as illustrated in FIGS. 11 and 12.

The crimp portion 5 is crimped by a crimp machine, not shown. The side portions 52 of the crimp portion 5 are bent such that they hold the conductors 21 of the plurality of electrical wires supported by the bottom portion 51, whereby the conductors 21 of the electrical wires are held by the crimp portion 5 (see FIGS. 11 and 12). When the crimp portion 5 is crimped, bell mouths 54 are formed to suppress damage to the conductors 21 which might be caused by the edges of the crimp portion 5.

After the crimp portion 5 is crimped, the quality of the crimping (whether or not the side portions 52 of the crimp portion 5 are correctly bent, and the conductors 21 of the electrical wires are correctly held by the crimp portion 5) is inspected.

To inspect the quality of the crimping, two kinds of inspections, i.e. visual inspection and cross-section inspection are performed. The visual inspection is performed to inspect the appearance of the crimped crimp portion 5, and the cross-section inspection is performed to inspect the cross-section of the crimped crimp portion 5 using a magnifier or a microscope.

First, a description will be given of the visual inspection.

Figure 13:
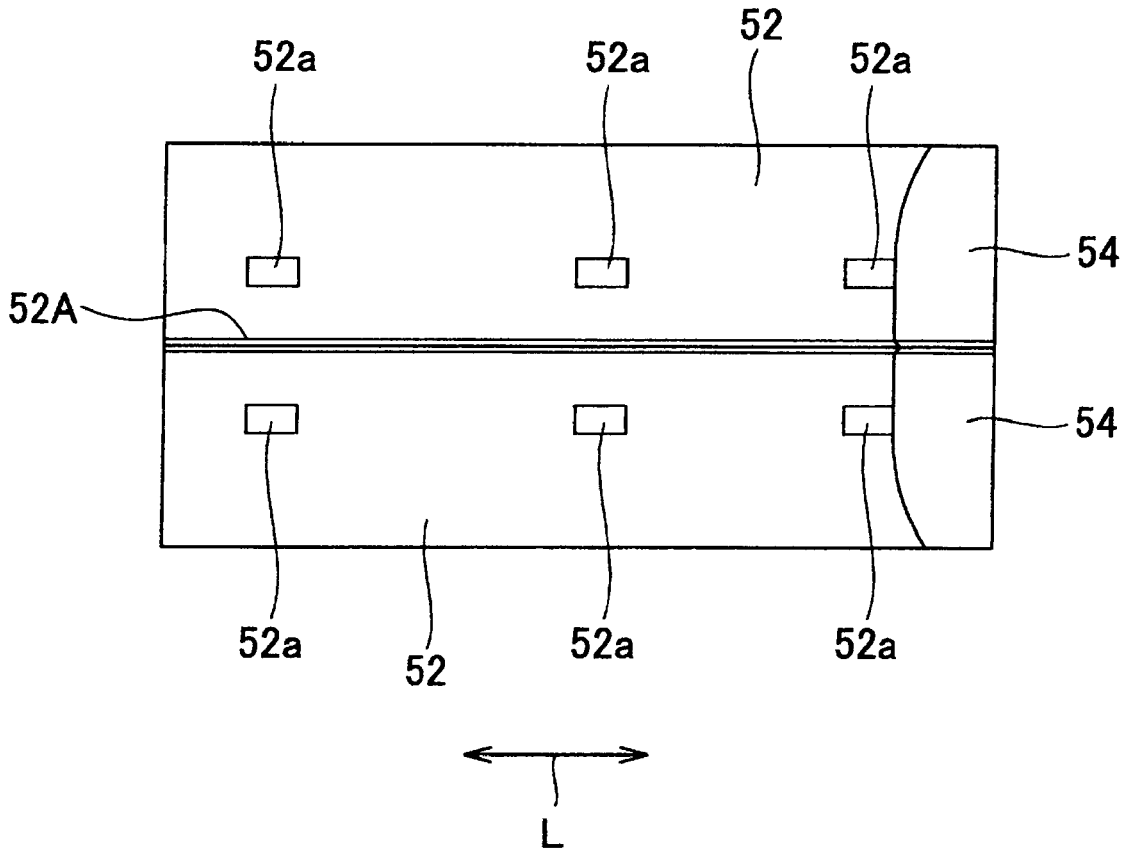
FIG. 13 is a plan view of the crimp portion shown in FIG. 11.
Figure 14:
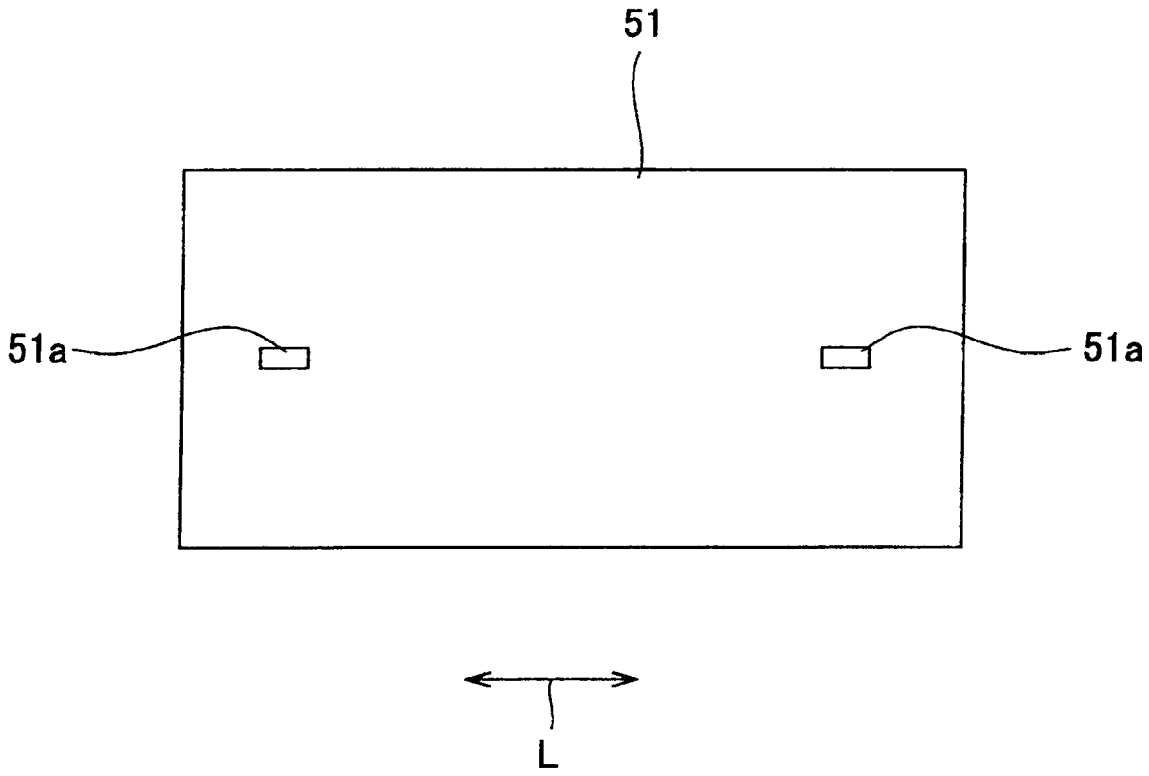
FIG. 14 is a bottom view of the crimp portion shown in FIG. 11.

Referring to FIG. 13, if the three marks 52*a* formed in each of the respective side portions 52 are aligned on the single imaginary line parallel to the longitudinal direction L of the contact, it is possible to determine that the quality of the crimping of the crimp portion 5 is good, whereas if the three marks 52*a* are not aligned on the single imaginary line parallel to the longitudinal direction L of the contact, it is possible to determine that the quality of the crimping of the crimp portion 5 is not good. For example, when one of the three marks 52*a* formed in each of the respective side portions 52 is disposed on an imaginary line which passes through the other two marks 52*a*, it is possible to determine that the quality of the crimping of the crimp portion 5 is good, whereas when one of the three marks 52*a* is not disposed on the imaginary line, it is possible to determine that the quality of the crimping of the crimp portion 5 is not good.

In the present embodiment, the marks 52*a* are arranged in the respective portions of the side portions 52, which are to form ridges of the side portions 52 when the side portions 52 are bent, so that as shown in FIG. 13, during the visual inspection, the marks 52*a* formed in both of the two side portions 52 can be viewed at the same time.

Further, it is possible to confirm whether or not the marks 52*a* formed in both of the side portions 52 are bilaterally symmetrical with respect to a meeting portion 52A of the side portions 52, extending in parallel with the longitudinal direction L of the contact as a center line, so that it is possible to determine more accurately the quality of the crimping of the crimp portion 5.

Next, a description will be given of the cross-section inspection.

In the cross-section inspection, first, the crimp portion 5 is cut. At this time, the crimp portion 5 is cut at the position of a predetermined mark 52*a* of the three marks 52*a* in one of the side portions 52 (the left-most mark 52*a*, as viewed in FIG. 13) and at the position of a predetermined mark 52*a* of the three marks 52*a* in the other side portion 52 (the left-most mark 52*a*, as viewed in FIG. 13), so that the position where the crimp portion 5 is cut is constant.

The predetermined mark 52*a* of the three marks 52*a* in the one side portion 52, the predetermined mark 52*a* of the three marks 52*a* in the other side portion 52, and a predetermined bottom surface-side mark 51*a* of the two bottom surface-side marks 51*a* are located on an imaginary plane F1 (see FIG. 11). Therefore, the two marks 52*a* and 52*a*, and the single bottom surface-side mark 51*a* appear on a cut cross-sectional surface of the crimp portion 5 (see FIG. 12).

The marks 52*a* in both the side portions 52 are formed at positions where the ridges of the respective side portions 52 are to be formed when the side portions 52 are bent, and hence as shown in FIG. 12, if the two marks 52*a* and 52*a* on the cut cross-sectional surface of the crimp portion 5 are located on the ridges of the two bent side portions 52, respectively, and an inverted isosceles triangle is formed by connecting between the two marks 52*a* and 52*a* and the single bottom surface-side mark 51*a* appearing on the cut cross-sectional surface using imaginary lines IL, it is possible to determine that the quality of the crimping of the crimp portion 5 is good, whereby it is possible to estimate that the crimping strength of the crimp portion 5 to the conductors 21 of the electrical wires is sufficient. On the other hand, if the inverted isosceles triangle is not formed, it is possible to determine that the quality of the crimping of the crimp portion 5 is not good, whereby it is possible to estimate that the crimping strength of the crimp portion 5 to the conductors 21 is not sufficient.

According to the first embodiment, by using the marks 52*a*, it is possible to easily and accurately determine the quality of the crimping of the crimp portion 5.

Since the three marks 52*a* are formed in each side portion 52, it is easier to determine whether or not the plurality of marks 52*a* are aligned on a single imaginary line parallel to the longitudinal direction L of the contact, than when two marks 52*a* are formed in each side portion 52, and therefore it is possible to easily and accurately determine the quality of the crimping of the crimp portion 5.

If the quality of the crimping of the crimp portion 5 is not good, the marks 52*a* are displaced in a direction orthogonal to the longitudinal direction L of the contact. However, since each mark 52*a* extends in the longitudinal direction L of the contact, it is possible to easily find the displacement of the marks 52*a*.

Further, the marks 52*a* are formed at the positions where the ridges of the respective side portions 52 are to be formed when the side portions 52 are bent. Therefore, during the visual inspection, the marks 52*a* formed in both of the two side portions 52 are to be located at a top of the crimp portion 5, so that it is possible to view the marks 52*a* formed in both of the two side portions 52 at the same time. Moreover, it is possible to view whether or not the marks 52*a* formed in both the two side portions 52 are bilaterally symmetrical with respect to the meeting portion 52A of the side portions 52. This makes it possible to determine more easily and accurately the quality of the crimping of the crimp portion 5.

To perform the cross-section inspection, the crimp portion 5 is cut at the position of marks 52*a*, whereby it is possible to cut the crimp portion 5 at a fixed position. Further, in the cross-section inspection, by confirming whether or not an inverted isosceles triangle is formed when the two marks 52*a* and the single bottom surface-side mark 51*a* appearing on the cut cross-sectional surface of the crimp portion 5 are connected using the imaginary lines IL, it is possible to easily and accurately determine the quality of the crimping of the crimp portion 5, and thereby estimate the crimping strength of the crimp portion 5 to the conductors 21.

Next, a variation of the contact 1 according to the first embodiment of the present invention will be described with reference to FIG. 15.

Component parts identical to those of the contact according to the first embodiment are denoted by identical reference numerals, and detailed description thereof is omitted, while only main points of this variation different from the first embodiment will be described hereinafter.

Figure 15:
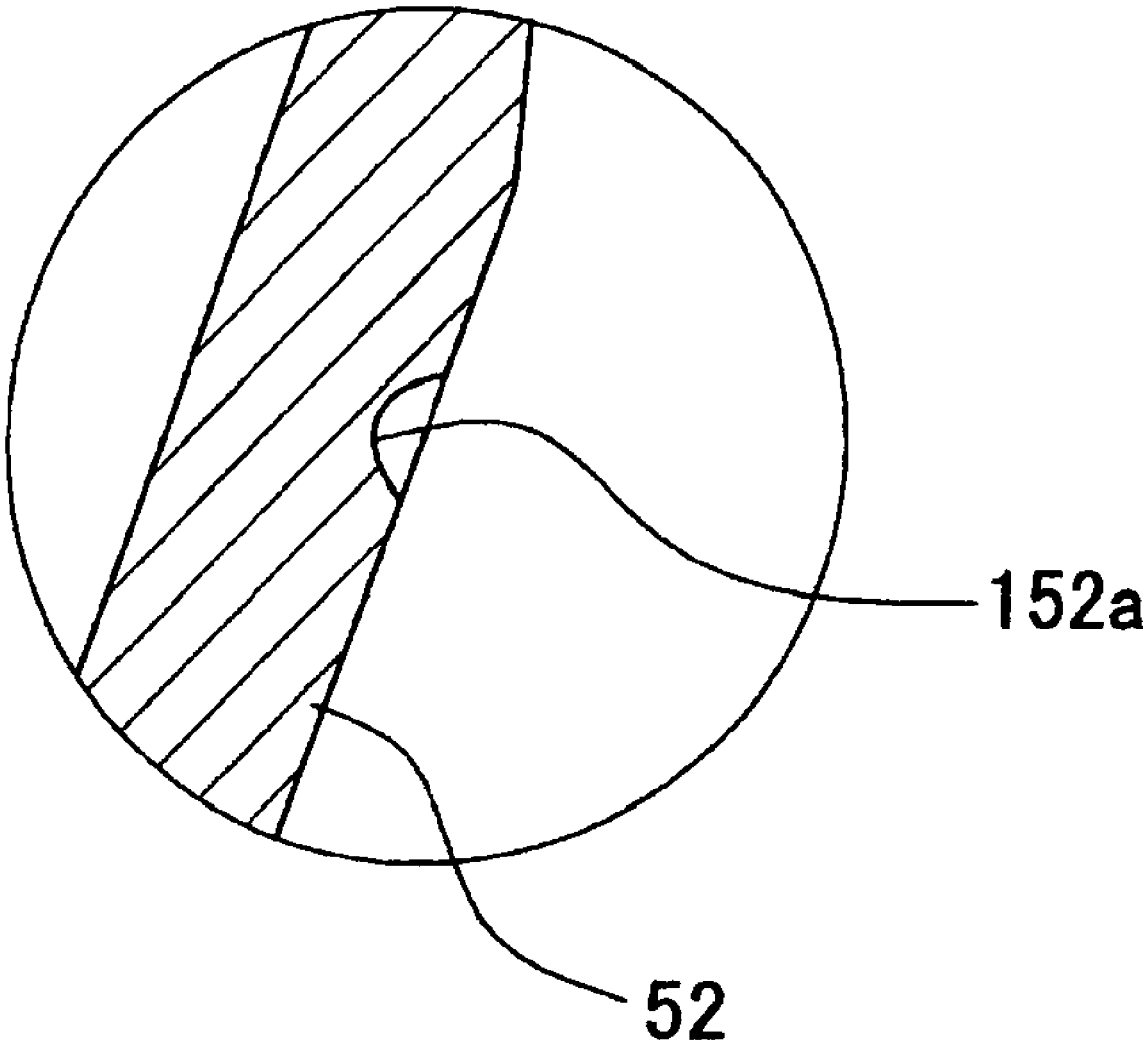
FIG. 15 is a view of a variation of the first embodiment, which is an enlarged view of the same portion as shown in FIG. 10.

Although in the contact 1 according to the first embodiment, the marks 52*a* have a concave shape with a rectangular cross-section, in the variation illustrated in FIG. 15, marks 152*a* have a concave shape but have a semi-circular cross-section. The construction of this variation is the same as that of the first embodiment, except for the cross-section of the marks 152*a*.

This variation provides the same advantageous effects as provided by the contact 1 according to the first embodiment.

Next, another variation of the contact 1 according to the first embodiment of the present invention will be described with reference to FIG. 16.

Component parts identical to those of the contact according to the first embodiment are denoted by identical reference numerals, and detailed description thereof is omitted, while only a main point of this variation different from the first embodiment will be described hereinafter.

Figure 16:
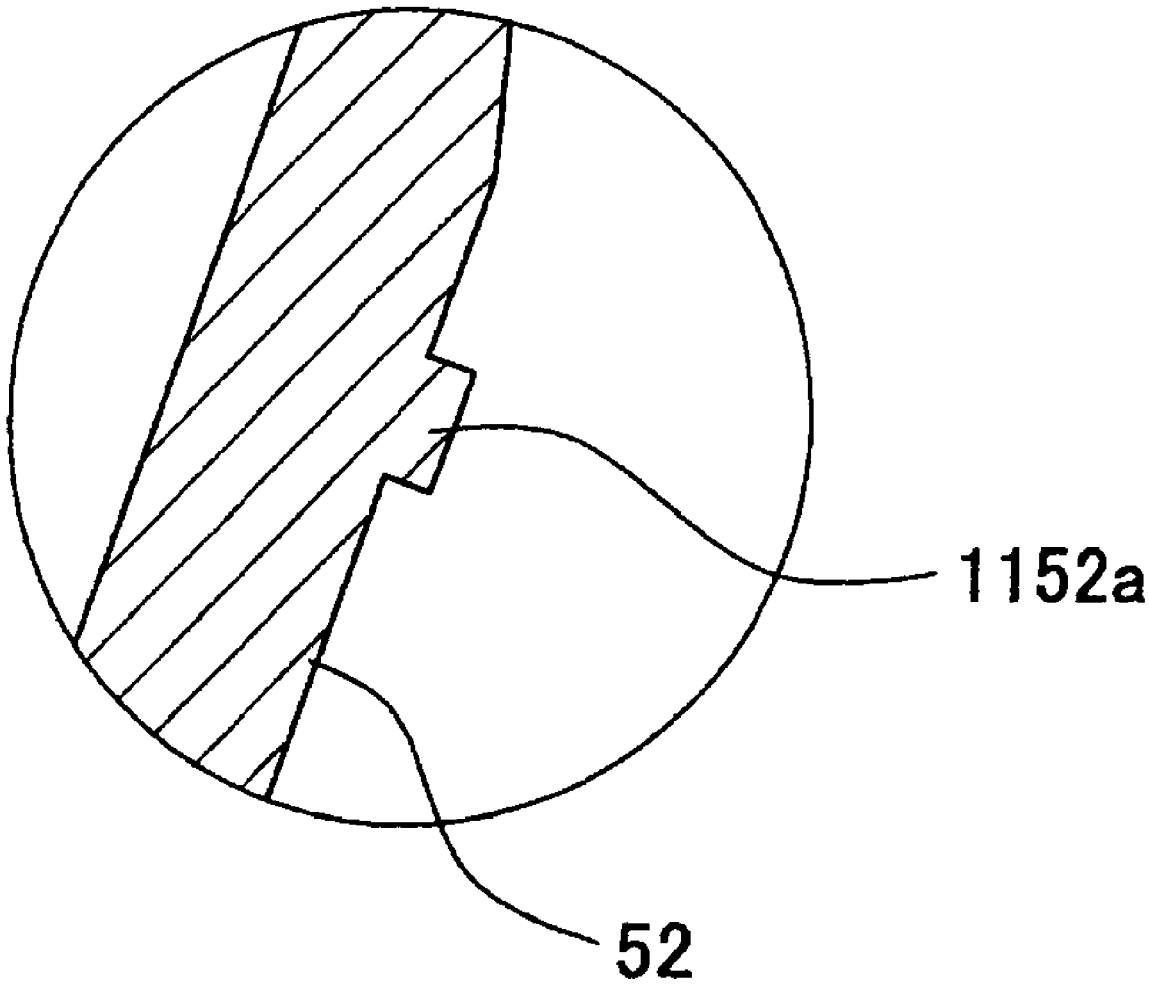
FIG. 16 is a view of another variation of the first embodiment, which is an enlarged view of the same portion as shown in FIG. 10.
Figure 17:
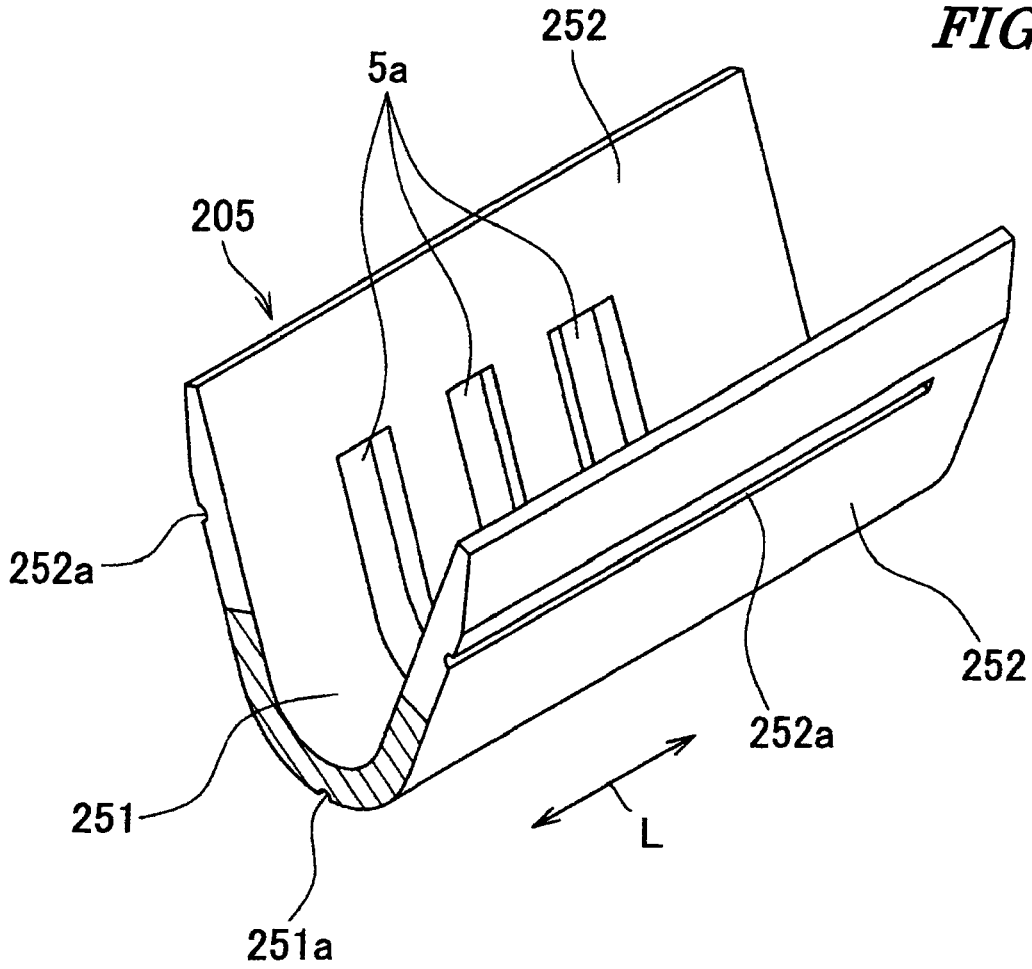
FIG. 17 is a perspective view of a crimp portion of a contact according to a second embodiment in a state before the crimp portion is crimped to conductors of electrical wires.
Figure 18:
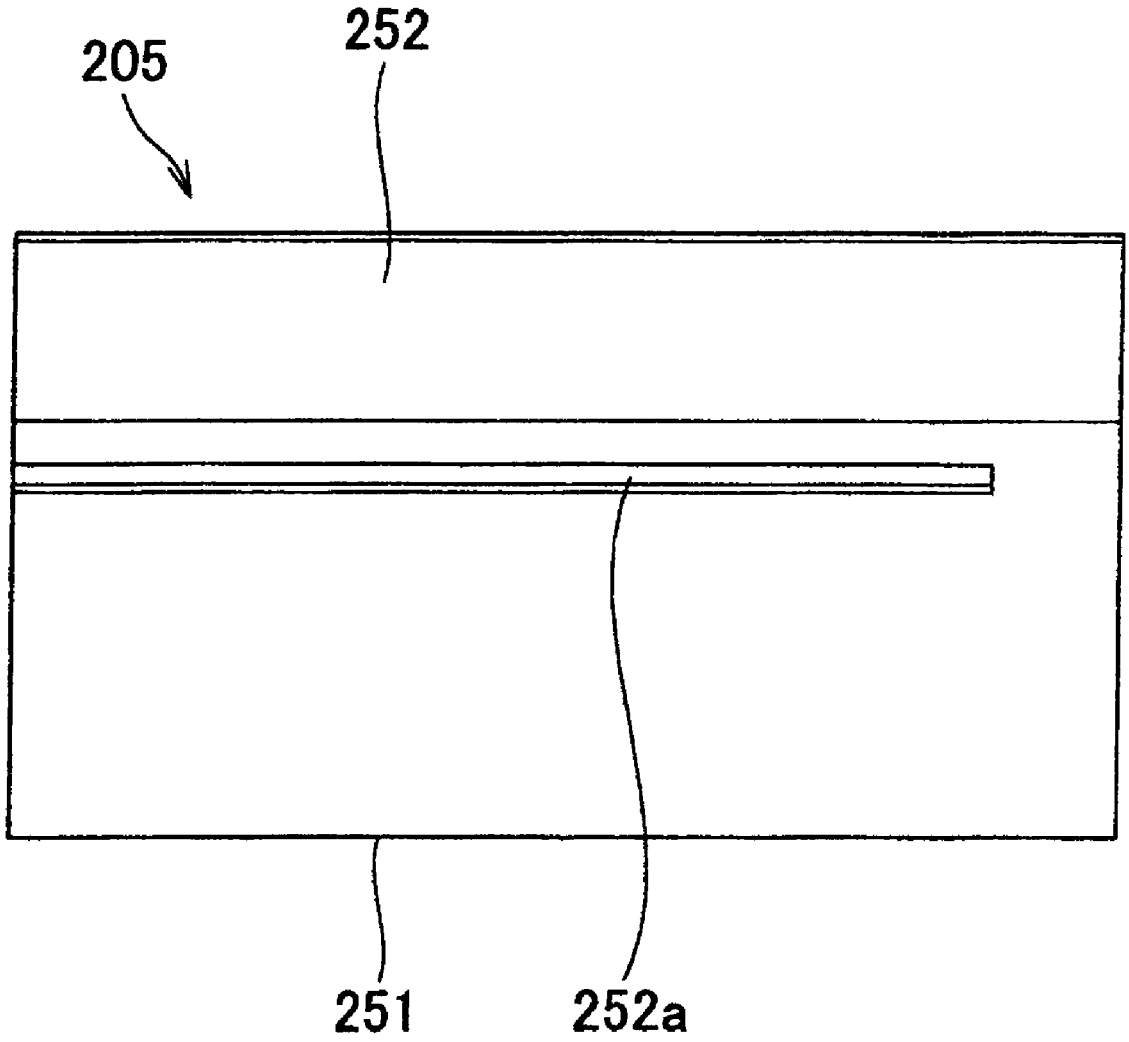
FIG. 18 is a side view of the crimp portion shown in FIG. 17.
Figure 19:
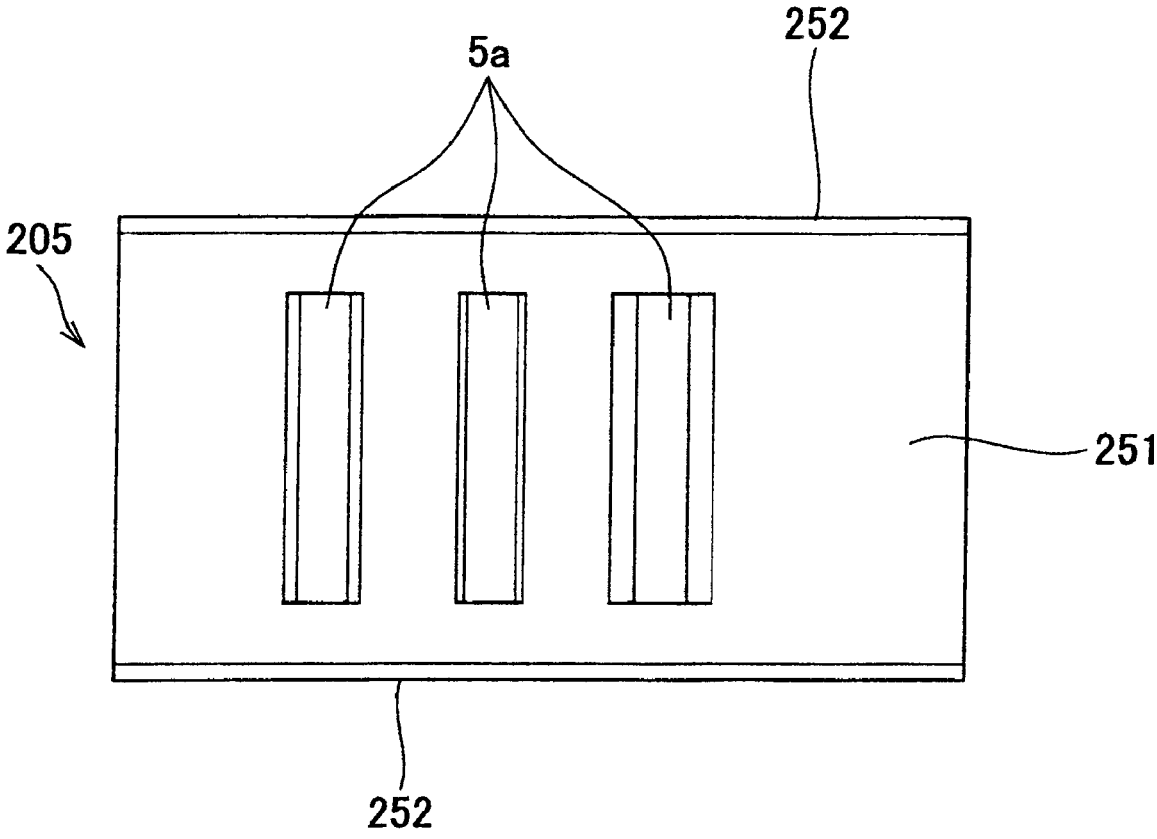
FIG. 19 is a plan view of the crimp portion shown in FIG. 17.
Figure 20:
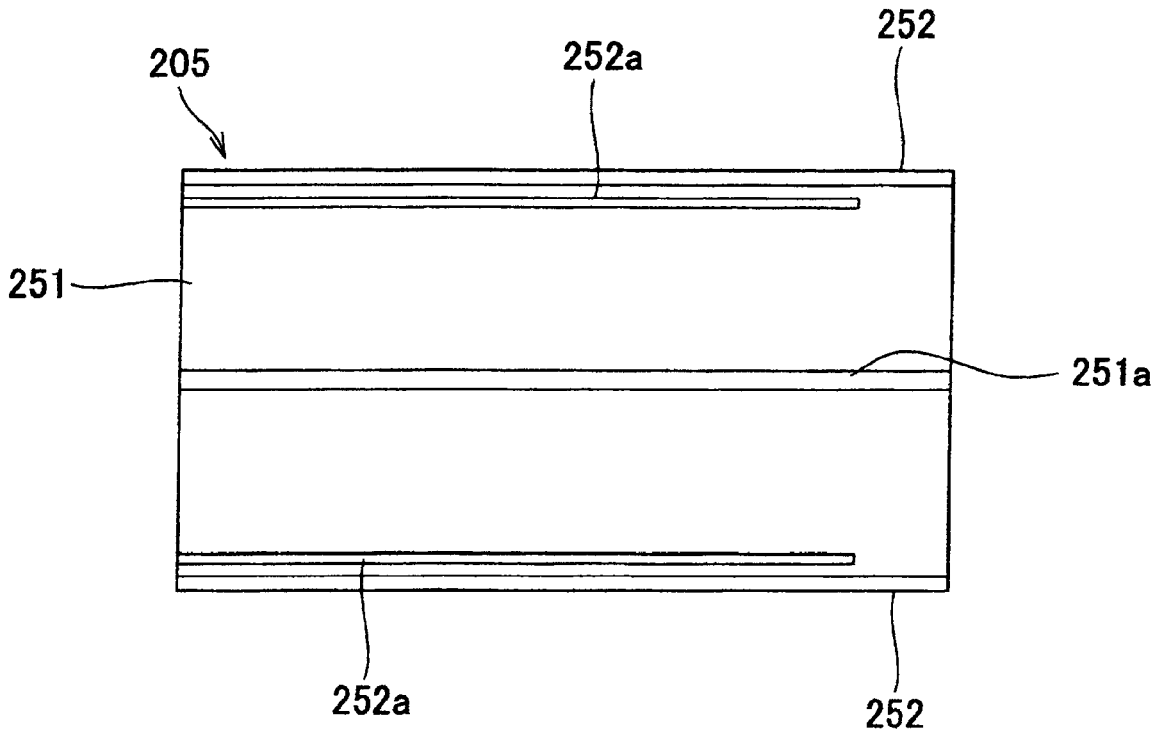
FIG. 20 is a bottom view of the crimp portion shown in FIG. 17.

Although in the contact 1 according to the first embodiment, the marks 52*a* and the bottom surface-side marks 51*a* have a concave shape, in the variation illustrated in FIG. 16, marks 1152*a* and bottom surface-side marks (not shown) have a convex shape. The construction of this variation is the same as that of the first embodiment, except that the marks 1152*a* and the bottom surface-side marks have the convex shape.

This variation provides the same advantageous effects as provided by the contact 1 according to the first embodiment.

Next, a contact according to a second embodiment of the present invention will be described with reference to FIGS. 17 to 24.

Component parts identical to those of the contact according to the first embodiment are denoted by identical reference numerals, and detailed description thereof is omitted, while only a main point of the second embodiment different from the first embodiment will be described hereinafter.

Although in the first embodiment, concave portions are formed in the bottom portion 51 and the side portions 52 of the crimp portion 5 as the bottom surface-side marks 51*a* and the marks 52*a*, in the second embodiment, grooves that extend in the longitudinal direction L of the contact from a front end-side portion to a rear end-side portion of an outer surface of a crimp portion 205 are formed in a bottom portion 251 and side portions 252 of the crimp portion 205 as a bottom surface-side mark 251*a* and marks 252*a*. The construction of the second embodiment is the same as that of the first embodiment except for this different point.

FIGS. 21, 22, 23, and 24 illustrate a state of the side portions 252 of the crimp portion 205 with the good quality of the crimping, in which the bottom surface-side mark 251*a* extends straight in the bottom portion 251 in parallel with the longitudinal direction L of the contact, while the marks 252*a* are located on respective ridges of the bent side portions 252, and extend straight in parallel with the longitudinal direction L of the contact.

Figure 23:
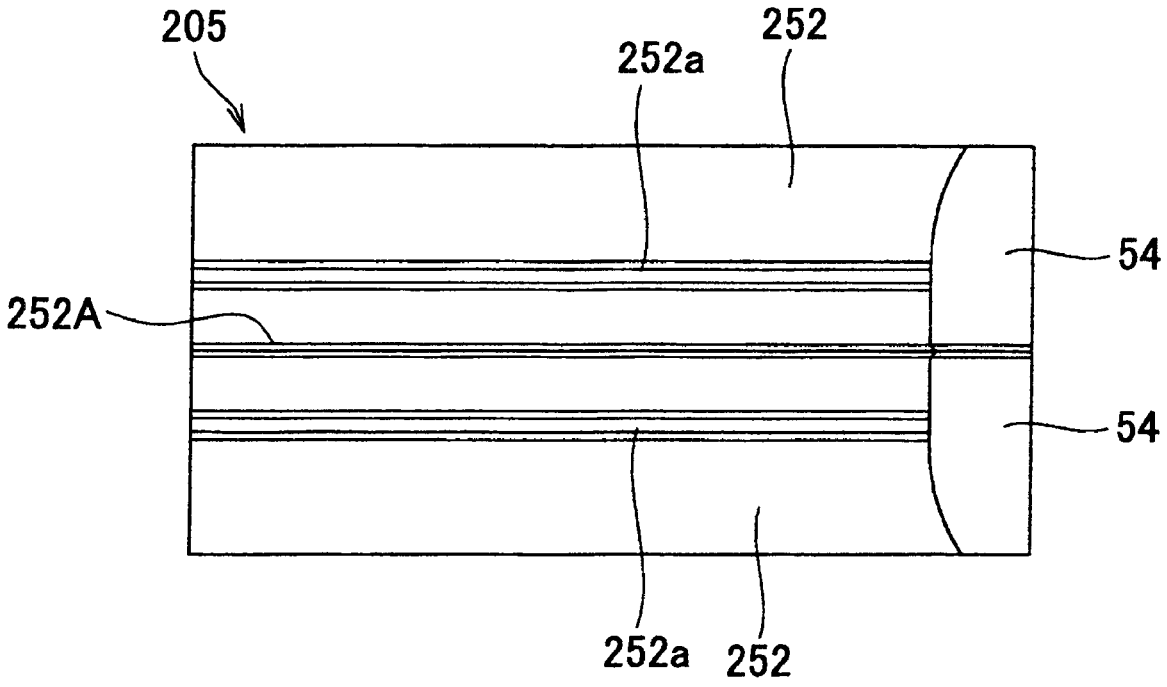
FIG. 23 is a plan view of the crimp portion shown in FIG. 21.
Figure 24:
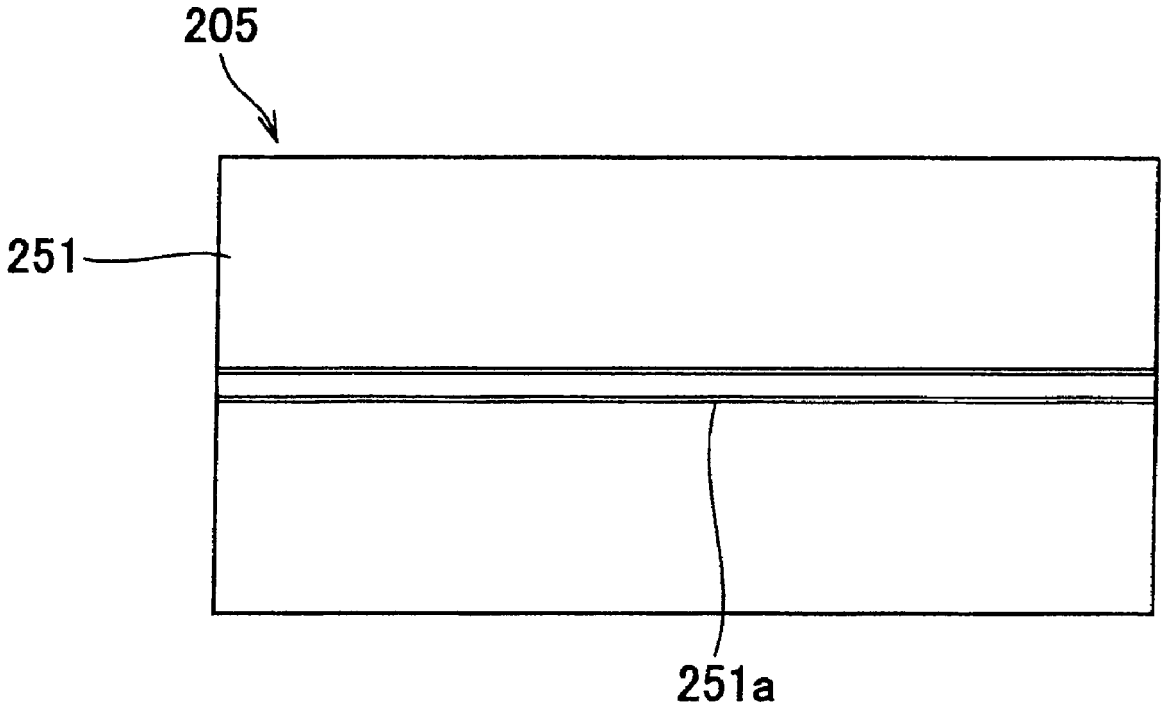
FIG. 24 is a bottom view of the crimp portion shown in FIG. 21.

When the quality of the crimping of the crimp portion 205 is not good, the marks 252*a* are curved or inclined with respect to the longitudinal direction L of the contact, whereby the marks 252*a* in the two side portions 252 are not bilaterally symmetrical with respect to a meeting portion 252A (see FIG. 23).

According to the second embodiment, it is possible to obtain the same advantageous effects as provided by the first embodiment. Further, since the bottom surface-side mark 251*a* and the marks 252*a* are grooves, the marks 252*a* are curved or inclined when the quality of the crimping of the crimp portion 205 is not good, so that it is possible to determine the quality of the crimping of the crimp portion 5 more easily than in the first embodiment.

Figure 21:
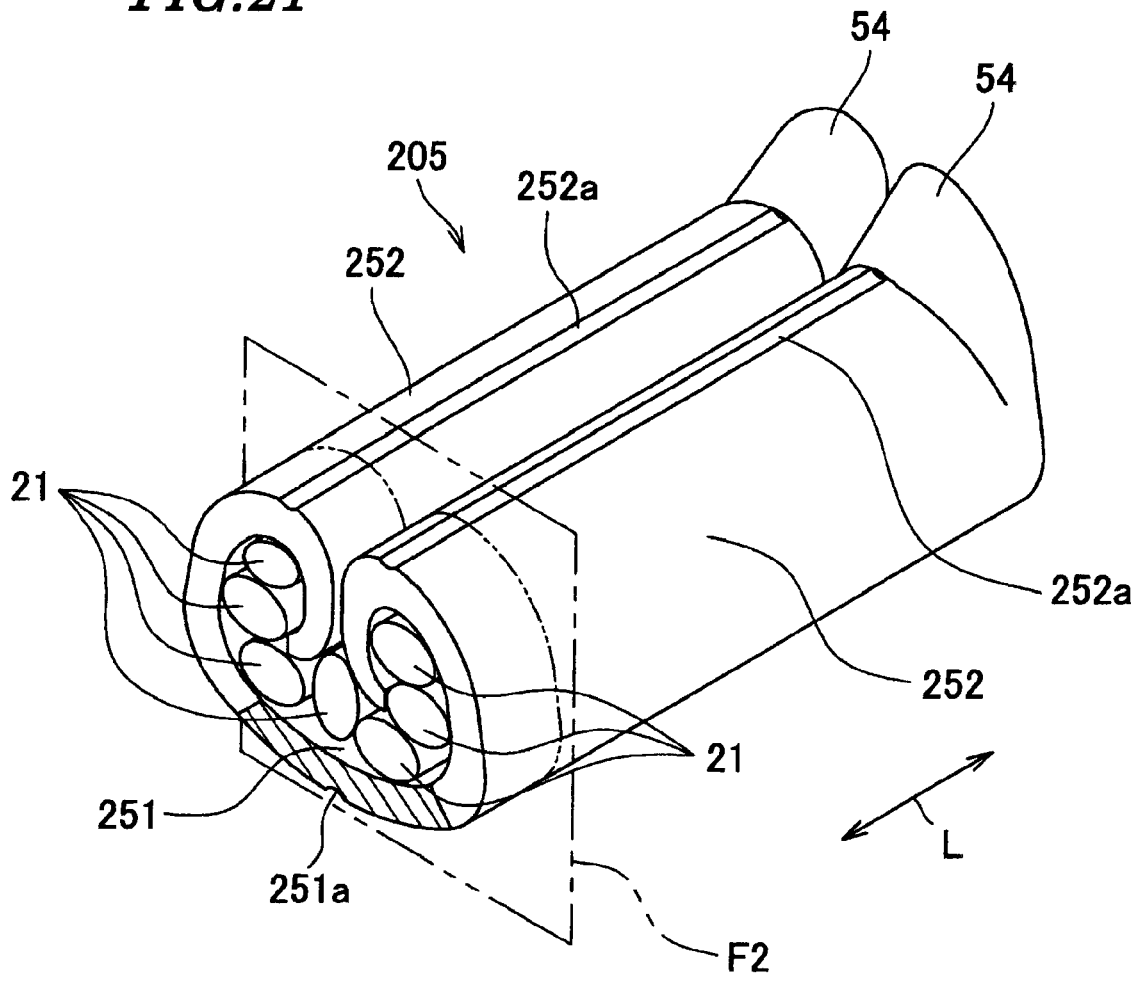
FIG. 21 is a perspective view of the crimp portion shown in FIG. 17 in a state after the crimp portion is crimped to the conductors of the electrical wires.
Figure 22:
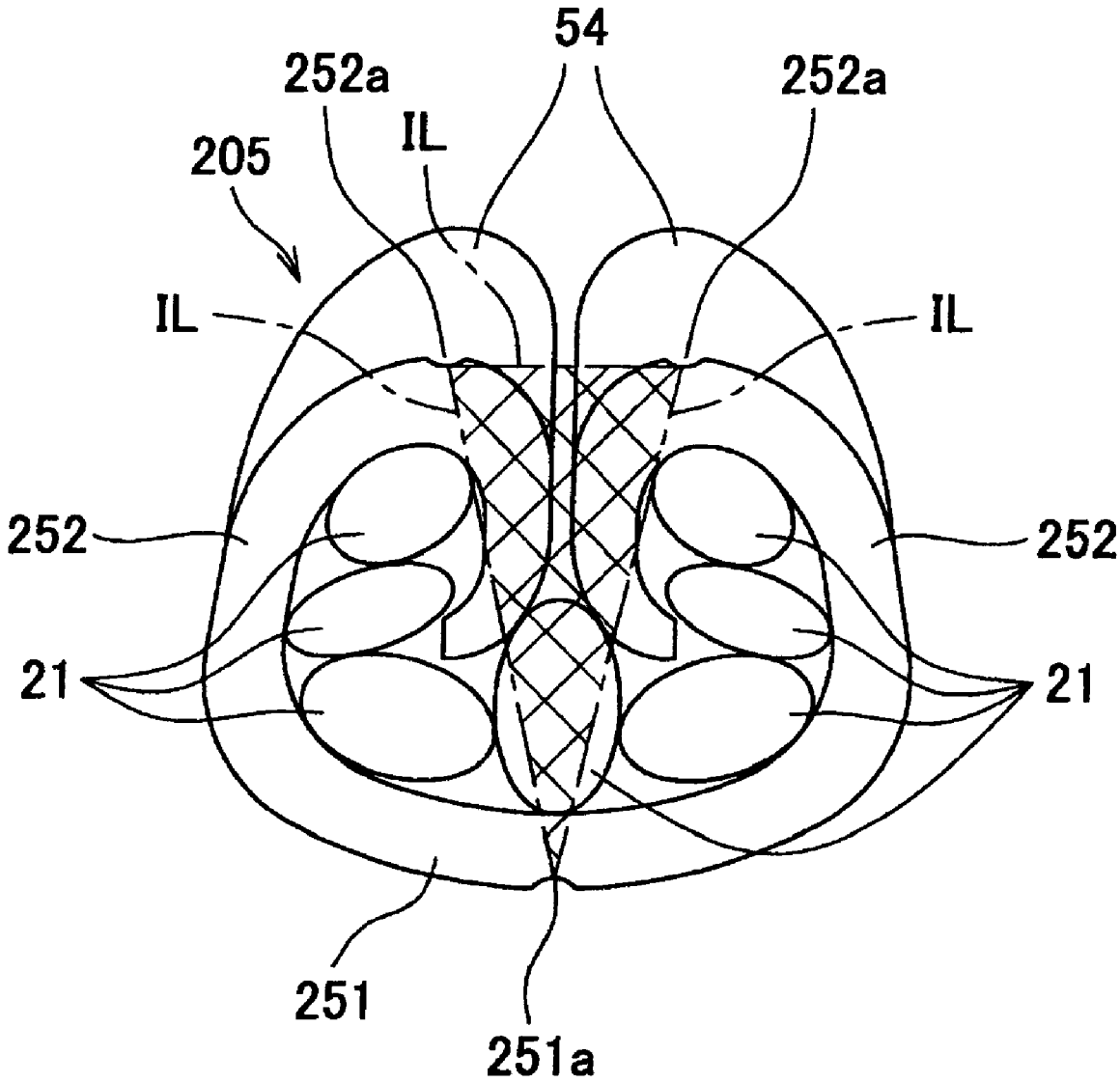
FIG. 22 is a schematic view showing a cross-section of the crimp portion along an imaginary plane F2 shown in FIG. 21.

As a variation (not shown) of the second embodiment, a contact is envisaged in which the position of one end of each mark 252*a* appearing in FIG. 21 (end thereof toward the first linking portion 8) is spaced from the position of one end of the crimp portion 205 (end thereof toward the first linking portion 8) by a predetermined distance. According to this variation, in performing the cross-section inspection, by cutting the crimp portion 205 at the position of the one end of each mark, it is possible to cut the crimp portion 205 at a fixed position.

Although in the first embodiment, the number of the marks 52*a* of each side portion 52 is three, and the number of the bottom surface-side marks 51*a* of the bottom portion 51 is two, while in the second embodiment, the number of the marks 252*a* of each side portion 252 is one and the number of the bottom surface-side mark 251*a* of the bottom portion 251 is one, the numbers of the marks are not limited to the above. For example, in the second embodiment, the marks 252*a* and the bottom surface-side marks 251*a* may be formed such that each comprises two marks adjacent to and in parallel with each other.

Further, although in the first embodiment, it is easy to find the abnormality of crimping of the crimp portion 5 since the marks 52*a* and the bottom surface-side marks 51*a* extend in the longitudinal direction L of the contact, it is not necessarily required that the marks 52*a* and the bottom surface-side marks 51*a* extend in the longitudinal direction L of the contact. Further, each of the bottom surface-side marks 51*a* and the marks 52*a* may be in the form of a hole.

Although in the above-described embodiments, the marks 52*a* having a concave shape, the marks 1152*a* having a convex shape, and the marks 252*a* formed by grooves are employed as marks, this is not limitative, but a paint may be caused to adhere to the surface of the crimp portion by coating or printing, so as to be used as marks.

Further, although in the above-described embodiments, the marks 52*a*, 152*a*, 1152*a*, and 252*a* are formed at the positions where the ridges of the respective side portions 52 and 252 are to be formed when the side portions 52 and 252 are bent, the positions of the marks are not limited to these. For example, the marks may be formed at positions which are to be close to the ridges of the respective side surfaces when the side portions 52 and 252 are bent, or positions away from the positions where the ridges are to be formed.

It is further understood by those skilled in the art that the foregoing are the preferred embodiments of the present invention, and that various changes and modification may be made thereto without departing from the spirit and scope thereof.

What is claimed is:

1. A contact including a crimp portion that holds conductors of electrical wires by crimping, wherein said crimp portion comprises:

a bottom portion that supports the conductors of electrical wires, and two side portions that are continuous with opposite sides of said bottom portion and are bent such that said side portions hold the conductors therein, wherein each side portion includes a plurality of marks which are formed on an outer surface thereof along a longitudinal direction of said contact before said side portion is bent, and wherein said plurality of marks are exposed to be visible on the outer surface of said side portion from outside said contact after said side portion has been bent.

2. The contact as claimed in claim 1, wherein the number of said marks is at least three.

3. The contact as claimed in claim 1, wherein said marks extend in the longitudinal direction of the contact.

4. The contact as claimed in claim 2, wherein said marks extend in the longitudinal direction of the contact.

5. The contact as claimed in claim 1, wherein when said side portions are bent such that said side portions hold the conductors therein, said marks are located at positions where ridges or portions close to the ridges of the respective side portions are to be formed.

6. The contact as claimed in claim 2, wherein said marks are located at positions where ridges or portions close to the ridges of the respective side portions are to be formed when said side portions are bent such that said side portions hold the conductors therein.

7. The contact as claimed in claim 3, wherein when said side portions are bent such that said side portions hold the conductors therein, and said marks are located at positions where ridges or portions close to the ridges of the respective side portions are to be formed.

8. The contact as claimed in claim 5, wherein each of said marks has a concave or convex shape, wherein a plurality of bottom-side marks each having a concave or convex shape are formed on an outer surface of said bottom portion along the longitudinal direction of the contact, and wherein at least one of said plurality of marks formed on one of said two side portions, at least one of said plurality of marks formed on the other of said two side portions, and at least one of said plurality of bottom-side marks are located on an imaginary plane through said crimp portion which is orthogonal to the longitudinal direction of the contact.

9. The contact as claimed in claim 6, wherein each of said marks has a concave or convex shape, wherein a plurality of bottom-side marks each having a concave or convex shape are formed on an outer surface of said bottom portion along the longitudinal direction of the contact, and wherein at least one of said plurality of marks formed on one of said two side portions, at least one of said plurality of marks formed on the other of said two side portions, and at least one of said plurality of bottom-side marks are located on an imaginary plane through said crimp portion which is orthogonal to the longitudinal direction of the contact.

10. The contact as claimed in claim 7, wherein each of said marks has a concave or convex shape, wherein a plurality of bottom-side marks each having a concave or convex shape are formed on an outer surface of said bottom portion along the longitudinal direction of the contact, and wherein at least one of said plurality of marks formed on one of said two side portions, at least one of said plurality of marks formed on the other of said two side portions, and at least one of said plurality of bottom-side marks are located on an imaginary plane through said crimp portion which is orthogonal to the longitudinal direction of the contact.

11. A contact including a crimp portion that holds conductors of electrical wires by crimping, wherein said crimp portion comprises:

a bottom portion that supports the conductors of electrical wires, and two side portions that are continuous with opposite sides of said bottom portion and are bent such that said side portions hold the conductors therein, wherein each side portion includes at least one mark which is formed on an outer surface thereof before said side portion is bent such that said mark extends from a front end-side portion to a rear end-side portion of said outer surface in a longitudinal direction of the contact, and wherein said at least one mark is exposed to be visible on the outer surface of said side portion from outside said contact after said side portion has been bent.

12. The contact as claimed in claim 11, wherein said marks are located at positions where ridges or portions close to the ridges of the respective side portions are to be formed when said side portions are bent such that said side portions hold the conductors therein.

13. The contact as claimed in claim 11, wherein said mark is a groove.

14. The contact as claimed in claim 12, wherein said mark is a groove.

15. The contact as claimed in claim 13, wherein at least one bottom-side mark is formed on said bottom portion such that said bottom-side mark extends from a front end-side portion to a rear end-side portion of an outer surface of said bottom portion in the longitudinal direction of the contact.

16. The contact as claimed in claim 14, wherein at least one bottom-side mark is formed on said bottom portion such that said bottom-side mark extends from a front end-side portion to a rear end-side portion of an outer surface of said bottom portion in the longitudinal direction of the contact.

* * * * *